US009927747B2

(12) United States Patent
Kuboyama et al.

(10) Patent No.: US 9,927,747 B2
(45) Date of Patent: Mar. 27, 2018

(54) FIXING MEMBER, METHOD FOR MANUFACTURING FIXING MEMBER, AND IMAGE FORMING APPARATUS

(71) Applicant: CANON KABUSHIKI KAISHA, Tokyo (JP)

(72) Inventors: Akane Kuboyama, Kawasaki (JP); Yusuke Baba, Yokohama (JP); Matsutaka Maeda, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/178,282

(22) Filed: Jun. 9, 2016

(65) Prior Publication Data

US 2016/0363890 A1 Dec. 15, 2016

(30) Foreign Application Priority Data

Jun. 12, 2015 (JP) ..... 2015-119286

(51) Int. Cl.
*G03G 15/20* (2006.01)
*B05D 3/02* (2006.01)

(52) U.S. Cl.
CPC ..... *G03G 15/206* (2013.01); *B05D 3/0254* (2013.01); *G03G 15/2053* (2013.01); *G03G 15/2057* (2013.01)

(58) Field of Classification Search
CPC ..... G03G 15/2053; G03G 9/08711; G03G 9/08755; G03G 15/2039; G03G 15/206; G03G 15/2025; G03G 2215/2035; G03G 15/2028; G03G 15/2064; G03G 9/0819; G03G 9/08797; G03G 9/09364; G03G 9/09392; B32B 27/322; B32B 1/08; B32B 15/08; B32B 27/08; B32B 27/18; B32B 2307/714; B32B 2457/08; B32B 27/304; B32B 27/34; B32B 27/36; B32B 2250/24;
(Continued)

(56) References Cited

U.S. PATENT DOCUMENTS

2005/0064122 A1* 3/2005 Oyama ..... B29C 53/581 428/36.9
2005/0207806 A1 9/2005 Yoshii et al.
2009/0041516 A1 2/2009 Fukaya
(Continued)

FOREIGN PATENT DOCUMENTS

JP 2003-167462 A 6/2003
JP 2004-077886 A 3/2004
(Continued)

*Primary Examiner* — Roy Y Yi
(74) *Attorney, Agent, or Firm* — Canon U.S.A., Inc. IP Division

(57) ABSTRACT

A method for manufacturing a fixing member having a substrate, an elastic layer on the substrate, and a release layer on the elastic layer, having a thickness of 15 μm or more and 25 μm or less, and containing a fluororesin includes (1) providing a coating solution, containing: the fluororesin having a melt flow rate (MFR) of 1 g/10 min or more and 3 g/10 min or less, and an acrylic resin;
(2) forming a coating film of the coating solution on the elastic layer; and
(3) baking the coating film to melt the fluororesin therein, covering a surface of the elastic layer with the melted fluororesin, and forming the release layer.

12 Claims, 3 Drawing Sheets

(58) Field of Classification Search
CPC ..... B32B 2264/102; B32B 2270/00; B32B 2307/306
See application file for complete search history.

(56) References Cited

U.S. PATENT DOCUMENTS

| | | | | |
|---|---|---|---|---|
| 2010/0104335 | A1* | 4/2010 | Kamimura ..... | G03G 15/2053 399/333 |
| 2010/0124661 | A1* | 5/2010 | Moorlag ..... | G03G 15/2057 428/421 |

FOREIGN PATENT DOCUMENTS

| | | | |
|---|---|---|---|
| JP | 2006-205151 | A | 8/2006 |
| JP | 2012-155199 | A | 8/2012 |

* cited by examiner

FIXING MEMBER, METHOD FOR MANUFACTURING FIXING MEMBER, AND IMAGE FORMING APPARATUS

BACKGROUND OF THE INVENTION

Field of the Invention

The present invention relates to a fixing member for use in a fixing device of an image forming apparatus employing an electrophotographic system and a method for manufacturing the same.

Description of the Related Art

In an electrophotographic image forming apparatus, such as a copying machine and a laser beam printer, a system employing a fixing member, such as a fixing roller or a fixing belt, has been adopted as a method for fixing a non-fixed toner image on a recording material by heat or pressure. In this system, a fixing member as a rotation member for heating and a rotation member for pressing (pressing member) which are disposed in such a manner as to form a pair therewith are brought into pressure contact with each other to form a nip portion. Then, due to the fact that a recording material, such as paper, bearing a non-fixed toner image passes through the nip portion, the toner is melted and pressed to form a fixed image.

Used as the fixing member are those having a configuration in which an elastic layer containing a heat-resistant rubber, such as silicone rubber, and a release layer containing a fluororesin are successively formed on the outer surface of a substrate. As a method for producing such a fixing member, a method is mentioned which includes applying a coating solution for forming a release layer (aqueous dispersion coating solution) containing fluororesin particles to the surface of an elastic layer to form a coating film, and then heating the coating film to a temperature equal to or higher than the melting point of the fluororesin for baking (hereinafter referred to as a "coating method").

However, in the coating method, during the heating of the coating film, the elastic layer containing a silicone rubber is also heated and expands as the temperature of the elastic layer rises. The expansion of the elastic layer may result in a formation of a crack in the release layer.

Japanese Patent Laid-Open No. 2006-205151 discloses a process for preventing a crack formation in a surface layer formed by the coating method. It discloses in paragraph 0028 that as a coating liquid for forming a release layer, it is preferable to use a fluororesin dispersion containing a film forming agent such as a water soluble acrylic resin. The film forming agent is considered to bind a fluororesin particles dispersed in the fluororesin dispersion until the fluororesin particles start melting, and therefore, formation of a crack in the surface layer is considered to be prevented.

On the other hand, the fixing member has been demanded to have higher durability with an increase in the printing speed in recent years. As a fixing member excellent in durability, Japanese Patent Laid-Open No. 2003-167462 describes a fixing member obtained by coating a fluororesin having a melt viscosity (Melt flow rate (MFR)) of 1 g/10 min to 3 g/10 min, and then baking the coating.

SUMMARY OF THE INVENTION

One aspect of the present invention is directed to providing a fixing member excellent in durability and having a smooth surface with few surface defects and a method for manufacturing the fixing member.

Another aspect of the present invention is directed to providing an image forming apparatus capable of stably providing high-definition images.

According to one aspect of the present invention, there is provided a method for manufacturing a fixing member having a substrate, an elastic layer on the substrate, and a release layer on the elastic layer, the release layer having a thickness of 15 μm or more and 25 μm or less, and containing a fluororesin, the method includes (1) providing a coating solution containing a fluororesin having a melt flow rate, MFR, of 1 g/10 min or more and 3 g/10 min or less, and an acrylic resin;

(2) forming a coating film of the coating solution on the elastic layer; and (3) baking the coating film to melt the fluororesin therein, covering a surface of the elastic layer with the melted fluororesin, and forming the release layer, wherein the step (3) includes: heating the coating film from T1° C. to T2° C. at a temperature increase rate of T3° C./second or more and T7° C. second or less, and then heating the coating film at T2° C. or higher than T2° C., where, T1° C. is a decomposition temperature of the acrylic resin, and T2° C. is the melting point of the fluororesin.

According to another aspect of the present invention, there is provided a fixing member having a substrate, an elastic layer on the substrate, and a release layer on the elastic layer, wherein, the release layer has a thickness of 15 μm or more and 25 μm or less, contains a fluororesin having a melt flow rate (MFR) of 1 g/10 min or more and 3 g/10 min or less, results from baking a coating film of a coating solution, provided on the elastic layer, the coating solution containing the fluororesin, and has a surface having arithmetic average roughness (Sa) of 0.1 μm or more and 0.5 μm or less, and having maximum cross sectional height (St) of 10.0 μm or less.

According to a further aspect of the present invention, there is provided an image forming apparatus having a fixing device having a fixing member and a heating unit, in which the fixing member is the fixing member described above.

Further features of the present invention will become apparent from the following description of exemplary embodiments with reference to the attached drawings.

DESCRIPTION OF THE EMBODIMENTS

Figure 1:
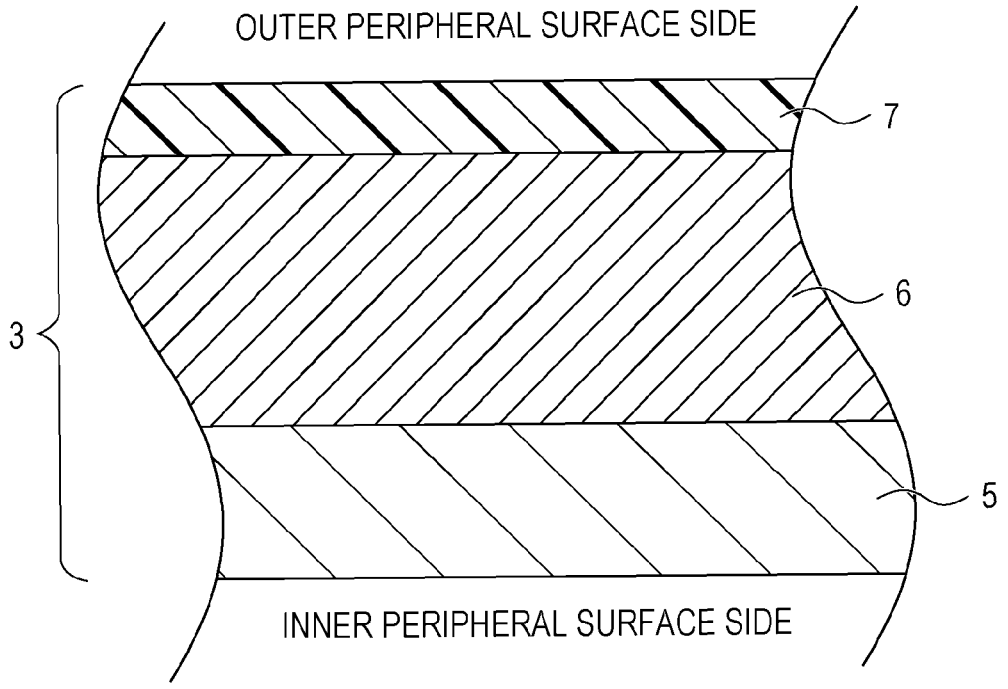
FIG. 1 is a cross sectional view of an example of the layer configuration of a fixing member according to the present invention.

In view of the description of Japanese Patent Laid-Open No. 2006-205151, the present inventors have made an attempt to form a release layer having a smooth surface using a coating solution for forming a release layer containing a mixture of a fluororesin having a MFR of 1 g/10 min to 3 g/10 min and a film forming agent. As a result, the present inventors have found that, when a release layer having a relatively large film thickness of 15 μm or more and 25 μm or less, for example, a void is formed in the release layer, which causes a surface defect dented in the thickness direction.

The present inventors have investigated the cause of the formation of the void in the release layer obtained by using a coating solution containing a fluororesin which has a MFR of 1 g/10 min or more and 3 g/10 min or less, and an acrylic resin as a film forming agent.

Japanese Patent Laid-Open No. 2006-205151 describes that, when the temperature of the fluororesin coating film is increased to the melting point of the fluororesin under mild temperature rise conditions, the acrylic resin is decomposed before the fluororesin is melted and united, so that cracks are likely to be generated in the release layer. Therefore, Japanese Patent Laid-Open No. 2006-205151 describes that the temperature increase rate to the melting point of the fluororesin is preferably 10° C./second or more and 50° C./second or less.

However, as a result of the investigation, it has revealed that when baking a coating film containing the fluororesin having a MFR of 1 g/10 min or more and 3 g/10 min or less, such a high temperature increase rate, i.e. 10° C./second or more and 50° C./second or less, may result in a formation of a surface defect which is different from the crack in the release layer.

More specifically, the fluororesin having a MFR of 1 g/10 min or more and 3 g/10 min or less has low fluidity in melting, and thus it is considered that decomposed substances of the acrylic resin are hard to be eliminated (volatilized) from the melted fluororesin film. Therefore, it is considered that the decomposed substances of the acrylic resin remain as bubbles in the melted fluororesin film, and then the bubbles are formed into voids to cause the surface defects in the release layer.

Particularly when the release layer is relatively thick (15 μm or more and 25 μm or less), the surface defects resulting from the voids are likely to occur. This is considered to be because the decomposed substances of the acrylic resin are more difficult to be eliminated from the melted fluororesin film.

Accordingly, the present inventors have found that, in order to form a release layer having a film thickness of 15 μm or more and 25 μm or less using a fluororesin having a MFR of 1 g/10 min or more and 3 g/10 min or less, it is important to heat a coating film containing the fluororesin at not so high temperature increase rate for baking, and thus have accomplished the present invention.

More specifically, a method for manufacturing a fixing member according to the present invention is a method for manufacturing a fixing member having a substrate, an elastic layer provided on the substrate, and a release layer which is provided on the elastic layer, has a thickness of 15 μm or more and 25 μm or less, and contains a fluororesin including (1) a process of forming a coating film of a coating solution for forming a release layer containing a fluororesin having a melt flow rate (MFR) of 1 g/10 min or more and 3 g/10 min or less and an acrylic resin on the elastic layer, and (2) a process of baking the coating film to form a release layer, in which in the process (2), when the decomposition temperature of the acrylic resin is set to T1° C. and the melting point of the fluororesin is set to T2° C., the temperature increase rate when the coating film is heated from T1° C. to T2° C. is 3° C./second or more and 7° C. second or less.

A fixing member according to the present invention is a fixing member having a substrate, an elastic layer provided on the substrate, and a release layer which is provided on the elastic layer, has a thickness of 15 μm or more and 25 μm or less, and contains a fluororesin, in which the fluororesin has a melt flow rate (MFR) of 1 g/10 min or more and 3 g/10 min or less, the release layer is formed by baking a coating film of a coating solution for forming a release layer containing the fluororesin, the arithmetic average roughness (Sa) of the surface of the release layer is 0.1 μm or more and 0.5 μm or less, and the maximum cross sectional height (St) of the surface of the release layer is 10.0 μm or less.

Hereinafter, details of the present invention are described with reference to the drawings.

Fixing Member

As a fixing member according to the present invention, a belt-shaped fixing belt and a roller-shaped fixing roller are preferably used. Hereinafter, one embodiment of the fixing member of the present invention is described taking a fixing belt as an example.

A fixing belt according to one embodiment of the present invention is a thin endless belt having flexibility.

FIG. 1 illustrates a partial cross sectional view of the fixing belt. A fixing belt 3 is a member having a multilayer structure in which a substrate 5, an elastic layer 6, and a release layer 7 are provided from the inner peripheral surface side toward the outer peripheral surface side of the fixing belt 3. The elastic layer 6 may have a multilayer configuration.

Substrate

As materials of the substrate 5, heat-resistant resin, such as polyimide, polyamideimide, and polyetheretherketone (PEEK) are preferably used. In order to further increase the thermal conductivity, materials, such as stainless steel and electroformed nickel, may be used.

The thickness of the substrate 5 is set to preferably 5 μm or more and 100 μm or less and particularly preferably 20 μm or more and 85 μm or less. By setting the thickness of the substrate 5 to 100 μm or less, the heat capacity of the fixing belt 3 can be reduced to a low level and quick start properties can be satisfied when attached to a fixing device. Moreover, by setting the thickness of the substrate 5 to 5 μm or more, it is possible to obtain the fixing belt 3 having sufficient mechanical strength.

Elastic Layer

The elastic layer 6 is provided on the outer peripheral surface of the substrate 5. By providing the elastic layer 6, it is possible to obtain good quality images with high gloss and less fixing unevenness. This is because the elastic layer 6 can be deformed in such a manner as to follow the fiber shape of toners 10 on a recording material 9 or the recording material 9 in a fixing nip portion 8 to wrap a non-fixed toner image, whereby heat can be uniformly given to the toner image.

The thickness of the elastic layer 6 is preferably 30 μm or more and 500 μm or less and particularly preferably 100 μm or more and 300 μm or less. When the thickness of the elastic layer 6 is 30 μm or more, the elasticity of the elastic layer 6 is sufficiently demonstrated, so that good quality images with high gloss and less fixing unevenness can be obtained. When the thickness of the elastic layer 6 is 100 μm or less, the heat capacity of the fixing belt 3 can be reduced to a low level and quick start properties can be satisfied when attached to a fixing device.

It is preferable for the elastic layer 6 to contain silicone rubber. The raw material of the silicone rubber may preferably be liquid silicone rubber which is a polymer having fluidity at room temperature and which is cured by heating. The elastic layer 6 formed with the liquid silicone rubber has moderately low hardness, and has sufficient heat resistance and deformation recovery force for use in a fixing device. In particular, due to the fact that the processability is good, the stability of the accuracy of dimension is high, and a reaction byproduct is not generated in a curing reaction, it is preferable to use an addition reaction crosslinking type liquid silicone rubber.

An addition reaction crosslinking type liquid silicone rubber composition contains the following substances (a), (b), and (c) as basic constituent components:

(a) Organopolysiloxane having an unsaturated aliphatic group;

(b) Organopolysiloxane having active hydrogen bonded to silicon;

(c) Hydrosilylation catalyst.

Examples of the organopolysiloxane having an unsaturated aliphatic group which is the (a) component include the following substances:

Linear organopolysiloxane in which both molecular terminals are represented by $R1_2R2SiO_{1/2}$ and the intermediate unit is represented by $R1_2SiO$ and R1R2SiO; and Branched polyorganosiloxane in which both molecular terminals is represented by $R1_2R2SiO_{1/2}$ and the intermediate unit contains $R1SiO_{3/2}$ and/or $SiO_{4/2}$.

Herein, R1 represents a monovalent unsubstituted or substituted hydrocarbon group which is bonded to a silicon atom and which does not contain an aliphatic unsaturated group. Specific examples include alkyl groups (for example, a methyl group, an ethyl group, an n-propyl group, an n-butyl group, an n-pentyl group, and an n-hexyl group), aryl groups (a phenyl group and a naphthyl group), and substituted hydrocarbon groups (for example, a chloromethyl group, a 3-chloropropyl group, a 3,3,3-trifluoropropyl group, 3-cyanopropyl group, and a 3-methoxypropyl group).

In particular, since the synthesis and the handling are easy and excellent heat resistance is obtained, it is preferable that 50% or more of R1s are methyl groups and it is more preferable that all the R1s are methyl groups.

R2 represents an unsaturated aliphatic group bonded to a silicon atom. As R2, a vinyl group, an aryl group, a 3-butenyl group, a 4-pentenyl group, and a 5-hexenyl group are mentioned as an example. Since the synthesis and the handling are easy and a crosslinking reaction of silicone rubber is easily performed, a vinyl group is particularly preferable.

The number average molecular weight of the organopolysiloxane which is the (a) component is preferably 5000 or more and 100000 or less. The weight average molecular weight is preferably 10000 or more and 500000 or less.

The organopolysiloxane having active hydrogen bonded to silicon which is the (b) component is a crosslinking agent which causes the formation of a crosslinking structure by a reaction with the alkenyl group of the (a) component due to the catalytic action of a platinum compound.

In the (b) component, the number of the hydrogen atoms bonded to the silicon atom is preferably more than 3 in one molecule on an average. Examples of organic groups bonded to the silicon atom include the same unsubstituted or substituted monovalent hydrocarbon groups as those of R1 of the organopolysiloxane component having an unsaturated aliphatic group. In particular, due to ease of synthesis and handling, a methyl group is preferable. The molecular weight of the organopolysiloxane having active hydrogen bonded to silicon is not particularly limited.

The viscosity at 25° C. of the (b) component is in the range of preferably 10 $mm^2/s$ or more and 100,000 $mm^2/s$ or less and more preferably 15 $mm^2/s$ or more and 1,000 $mm^2/s$ or less. When the viscosity is 10 $mm^2/s$ or more, the organopolysiloxane is hard to volatilize during storage and a desired degree of cross-linkage and desired physical properties can be obtained in silicone rubber to be obtained. When the viscosity is 100,000 $mm^2/s$ or less, the handling of the organopolysiloxane is easy and the organopolysiloxane can be easily uniformly dispersed in a system.

The siloxane frame of the (b) component may have a linear shape, a branched shape, or a cyclic shape and a mixture thereof can also be used. Among the above, due to ease of synthesis, one having a linear siloxane frame is preferable.

Moreover, in the (b) component, although the Si—H bond may be present in any siloxane unit in the molecules, at least one part thereof is preferably present in the molecular terminals of the organopolysiloxane, such as the $R1_2HSiO_{1/2}$ unit.

Furthermore, the (a) component and the (b) component are preferably blended in such a manner that the ratio of the number of the unsaturated aliphatic groups to the number of the silicon atoms is 0.001 or more and 0.020 or less and more preferably 0.002 or more and 0.010 or less in the addition curing type silicone rubber composition. Moreover, the (a) component and the (b) component are preferably blended in such a manner that the ratio of the number of the active hydrogen to the number of the unsaturated aliphatic groups is 0.3 or more and 0.8 or less. When the ratio of the number of the active hydrogen to the number of the unsaturated aliphatic groups is 0.3 or more, desired hardness can be stably obtained in silicone rubber after curing. When the ratio of the number of the active hydrogen to the number of the unsaturated aliphatic groups is 0.8 or less, excessive rise of the hardness of the silicone rubber can be suppressed. The ratio of the number of the active hydrogen to the number of the unsaturated aliphatic groups can be calculated by quantifying the number of the unsaturated aliphatic groups and the number of the active hydrogen by measurement using a hydrogen nuclear magnetic resonance analysis (1H-NMR (Trade name: AL400 type FT-NMR, manufactured by JEOL Co., Ltd.)).

Examples of the (c) component include known substance, such as a platinum compound and a rhodium compound.

Moreover, a reaction control agent (inhibitor) may also be contained besides the components (a) to (c). As the reaction control agent, known substances, such as methylvinyltetrasiloxane, acetylene alcohols, siloxane modified acetylene alcohol, and hydroperoxide, can be used.

Moreover, in order to increase the thermal conductivity of the elastic layer 6, a high thermal conductive filler (hereinafter referred to as a "filler") is preferably contained in the elastic layer 6. As the filler, SiC, ZnO, $Al_2O_3$, AlN, MgO, and carbon can be used. These fillers may be used alone or as a mixture of two or more kinds thereof. By blending the fillers in the elastic layer 6, electroconductivity can be also given to the elastic layer 6.

Release Layer

On the outer peripheral surface of the elastic layer 6, the release layer 7 containing a fluororesin is provided. By providing the release layer 7, the adhesion of the toners 10, which are melted by heating, to the surface of the fixing belt 3 can be suppressed.

As the fluororesin forming the release layer 7, a tetrafluoroethylene•perfluoroalkyl vinyl ether copolymer (PFA) resin, a tetrafluoroethylene (PTFE) resin, and a tetrafluoroethylene•hexafluoride propylene copolymer (FEP) resin are preferably used. Among the fluororesins above, it is preferable to use the PFA resin excellent particularly in the releasability of the toner 10 as the main fluororesin component. The proportion of the PFA resin in the fluororesin is preferably 50% by mass or more and 100% by mass or less.

As the fluororesin, those having a large a molecular weight, i.e., a low melt flow rate (MFR), are preferably used when wear resistance and a heat transfer property are taken into consideration. Specifically, a fluororesin having a MFR in the range of 1 g/10 min or more and 3 g/10 min or less is used.

Although a fluororesin having a MFR outside the numerical range mentioned above may be contained in the release layer 7, the entire MFR of the fluororesins contained in the release layer 7 is preferably 1 g/10 min or more and 3 g/10 min or less from the viewpoint of durability.

The MFR of the fluororesin is a value measured using a standard die under the conditions of a temperature of 372° C. and a load of 5 kgf according to the A method of JIS K7210-1:2014. As a measurement specimen of the MFR, one obtained by scraping off 4 to 6 g of the release layer 7 of the fixing belt 3 can be used, for example.

The arithmetic average roughness (Sa) of the surface of the release layer 7 is 0.1 μm or more and 0.5 or less. When the arithmetic average roughness (Sa) is 0.5 μm or less, the contact state of the recording material 9 and the toners 10 and the fixing belt 3 in the nip portion 8 is good. Therefore, the toners 10 can be sufficiently melted, so that a good quality image can be obtained. When the arithmetic average roughness (Sa) is lower than 0.1 μm and the surface is excessively smooth, image defects referred to as offset may occur. This is because the attachment force of the toners 10 to the release layer 7 is likely to be higher than adhesion force between the recording material 9 and the toners 10, and therefore, when the recording material 9 and the fixing belt 3 pass through the nip portion 8, the toners 10 are partially attached to the surface of the fixing belt 3 without fixed onto the recording material 9, so that the toner 10 sometimes circulates with the fixing belt 3. As a result, when the fixing belt 3 contacts the recording material 9 next, the toners moved onto the fixing belt 3 are fixed to the recording material 9, which may cause the offset.

In the present invention, the maximum cross sectional height (St) of the surface of the release layer 7 is 10.0 μm or less. When a portion in which the maximum cross sectional height (St) is higher than 10.0 μm is present on the surface of the release layer 7, defects may occur on an image to be formed. The maximum cross sectional height (St) is preferably 0.2 μm or more.

The arithmetic average roughness (Sa) and the maximum cross sectional height (St) are parameters obtained by three dimensionally extending "Arithmetic average roughness (Ra) of roughness curve" and "Maximum cross sectional height (Rt) of roughness curve", respectively, which are parameters showing the line roughness specified in Japanese Industrial Standards (JIS) B0601:2001. These parameters can be measured with a commercially available noncontact type white interferometer (for example, VertScan (manufactured by Ryoka Systems Inc.)). Specifically, the parameters are measured as follows.

First, a three-dimensional image of the surface of the fixing belt 3 is obtained using a 5 power objective lens in the measurement range XY=952×702 μm. Then, the obtained image is approximated by a quadratic curve based on the height data of the entire measurement range region to obtain an approximate curved surface, and then plane adjustment is performed in such a manner that the approximate curved surface is horizontal (secondary curved surface adjustment).

Next, in the image subjected to the plane adjustment, waviness components are removed at a cutoff value of 500 μm, so that the measurement surface is obtained. The entire region (952×702 μm) of the obtained measurement surface is set as an evaluation region, and then the arithmetic average roughness (Sa) and the maximum cross sectional height (St) of the measurement surface are individually determined. Herein, the arithmetic average roughness (Sa) is calculated as the average value of the absolute value of the height at each point in the evaluation region. The maximum cross sectional height (St) is calculated as the sum of the maximum peak height and the maximum valley depth from an average surface in the evaluation region. The maximum cross sectional height (St) as used in the present invention is determined without excluding a local defect or a local roughness change portion in a part of the surface of the release layer 7, if any.

This measurement is performed on the entire surface of the fixing belt 3. In the present invention, the arithmetic average roughness (Sa) in all the measurement surfaces and the maximum cross sectional height (St) in all the measurement surfaces individually fall within the numerical value ranges mentioned above. However, the same does not always apply to a region through which the recording material 3 does not pass in the surface of the fixing belt 3.

The thickness of the release layer 7 is set to preferably 15 μm or more and 25 μm or less and particularly preferably 18 μm or more and 22 μm or less. When the thickness of the release layer 7 is 15 μm or more, the wear resistance and the rubbing resistance of the release layer 7 are good. When the thickness of the release layer 7 is 25 μm or less, the heat transfer property of the fixing belt 3 is good and the heat capacity of the fixing belt 3 can be reduced to a low level, and therefore the quick start properties of a fixing device can be achieved.

Method for forming release layer

In the present disclosure, the release layer 7 is formed by a coating method which includes the steps of: providing a coating solution for forming a release layer, the coating solution containing an acrylic resin, and a fluororesin having a melt flow rate, MFR, of 1 g /10 min. or more and 3 g/10 min. or less; forming a coating film of the coating solution on a surface of the elastic layer; and baking the coating film.

As a method for forming the release layer 7, a method including coating the surface of the elastic layer 6 with a fluororesin tube which is produced into a cylindrical shape by extrusion molding beforehand, and then adhering the same (hereinafter referred to as a "tube process") is mentioned in addition to the coating method. Among the above, the coating method is more advantageous from the viewpoint of processing accuracy or productivity. For example, the arithmetic average roughness (Sa) of the release layer 7 formed by the tube process is lower by one digit than that of the release layer 7 formed by the coating method. Therefore, the offset tends to be relatively likely to occur as compared with the release layer formed by the coating method.

A method for forming the release layer 7 by the coating method is described below.

(i) Process of Forming Coating Film

First, providing a coating solution for forming a release layer. The coating solution for forming a release layer contains a fluororesin having a melt flow rate of 1 g/10 min. or more and 3 g/10 min. or less. Then, the coating solution is applied onto the elastic layer 6, and then dried to form a coating film containing the fluororesin (hereinafter sometimes also referred to as a "coating film").

Herein, the coating solution for forming a release layer is one in which an acrylic resin as a film forming agent is dispersed in addition to the fluororesin.

The decomposition temperature (T1) of the acrylic resin is 200° C. or more and 280° C. or less and particularly preferably 220° C. or more and 260° C. or less.

The decomposition temperature (T1) of the acrylic resin is the decomposition start temperature when the temperature is increased to 25 to 400° C. at 1° C./min under the atmosphere in thermogravimetric analysis (TG) (manufactured by Mettler-Toledo K.K.: Trade name: TGA851). The decomposition start temperature is defined as a temperature at the intersection between the straight line obtained by extending the baseline on the low temperature side to the high temperature side and the tangent at the point of inflection of a TG curve.

Examples of such an acrylic resin include polymers obtained by polymerizing one kind or two or more kinds of acrylic acids and derivatives thereof and methacrylic acids and derivatives thereof. Examples of the derivatives include esters and acid anhydrides and those containing alkyl groups having 1 to 8 carbon atoms are particularly preferable. Preferable specific examples of the acrylic resin include polymers obtained by polymerizing one kind or two or more kinds of acrylic acid, methacrylic acid, methyl acrylate, ethyl acrylate, methyl methacrylate, and ethyl methacrylate. In particular, a terpolymer containing methyl methacrylate, ethyl acrylate, and methacrylic acid is preferable.

The acrylic resin is preferably contained in a proportion of preferably 0.5% by mass or more and 30% by mass or less and particularly preferably 1% by mass or more and 20% by mass or less in the coating solution for forming a release layer.

The fluororesin contained in the coating solution for forming a release layer preferably has a particle shape because a surface layer is easily formed. The average particle diameter (Volume average particle diameter) of the fluororesin particles is preferably 0.1 μm or more and 0.5 μm or less. The volume average particle diameter of the fluororesin particles is a volume average particle diameter when measured by a light scattering method.

Examples of such fluororesin particles include, PFA:350-J, 450HP-J, 451HP-J, 950HP Plus, and 951HP Plus manufactured by Du Pont-Mitsui Fluorochemicals Co., Ltd.

The coating solution for forming a release layer may contain a surfactant and/or a viscosity modifier besides the substances mentioned above therein. Examples of the surfactant include nonionic surfactants, such as polyoxyethylene alkyl ether. Examples of the viscosity modifier include ethylene glycol.

The viscosity of the coating solution for forming a release layer is preferably higher than 300 cp and 1500 cp or less from the viewpoint of coatability of the coating solution. The viscosity as used herein is a value measured under the conditions of a temperature of 25° C. and a rotation speed of 20 rpm using a B type viscometer (manufactured by EKO Instruments, Trade name: DV-E).

Before applying the coating solution for forming a release layer onto the elastic layer, the elastic layer 6 may be subjected to surface treatment in order to improve the adhesiveness between the elastic layer 6 and the release layer 7. Specific examples of the surface treatment include the application of a silane coupling agent, ultraviolet ray (UV) irradiation, plasma treatment, and frame treatment. In particular, by performing the UV treatment, the tackiness of the surface of the silicone rubber elastic layer decreases and the surface of the silicone rubber elastic layer can be made hydrophilic. Two or more kinds of surface treatment may be used in combination, e.g., applying a silane coupling agent or the like after ultraviolet ray irradiation treatment.

(ii) Process of Forming the Release Layer by Baking a Coating Film

The step of "baking" includes: heating the coating film on the surface of the elastic layer 6 from a temperature of T1° C. to T2° C. at a temperature increase rate of 3° C./second or more and 7° C./second or less, and then heating the coating film at a temperature equal to T2° C. or higher than T2° C. to melt the fluororesin in the coating film, to cover the surface of the elastic layer with the melted fluororesin film and to form the release layer on the surface of the elastic layer. When the coating film is heated, the acrylic resin starts decomposition first, and then the fluororesin is melted and united to form a fluororesin film.

Herein, the decomposition temperature of the acrylic resin is set to T1° C. and the melting point of the fluororesin is set to T2° C., the coating film is heated in such a manner that the temperature increase rate when the coating film is heated from T1° C. to T2° C. is 3° C./second or more and 7° C./second or less. The temperature increase rate from T1° C. to T2° C. is a value represented by (T2−T1)/t, when the time required for heating the coating film from T1° C. to T2° C. is set to t (second). By setting the temperature increase rate in this range, the generation of voids or cracks is suppressed, so that the release layer 7 having a smooth surface can be formed. When the temperature increase rate exceeds 7° C./second, the temperature increase rate is excessively high, which results in the fact that voids are easily generated. When the temperature increase rate is less than 3° C./second, the temperature increase rate is excessively low, which results in the fact that cracks are easily generated.

The melting point (T2) of the fluororesin as used in the present invention is the peak top temperature of the endothermic peak when the temperature is increased at a temperature increase rate of 20° C./min in differential scanning calorimetry (DSC) (manufactured by Mettler-Toledo K.K.: Trade name DSC823). About 5 mg of a fluororesin is accurately weighed, and then put in an aluminum pan. Then, the measurement is performed in the temperature range of 50 to 400° C. using an empty aluminum pan as a reference. The melting point of the fluororesin is usually 280° C. or more and 320° C. or less and particularly preferably 290° C. or more and 315° C. or less.

In order to dissolve a fluororesin to form a film, the coating film is preferably heated at a temperature at least equal to or higher than T2+15° C. Specifically, it is preferable to heat the coating film in the temperature range of 320° C. or more and 400° C. or less according to the melting point (T2) of the fluororesin. The heating time of the coating film is desirably set to 1 minute or more and 15 minutes or less and more preferably 3 minutes or less because the heating causes thermal degradation of the elastic layer 6.

In the heating process of the coating film, it is preferable to use a baking device capable of performing uniform heating in such a manner that the temperature increase rate falls within the range mentioned above in the entire region of the coating film of the fluororesin. Examples of the baking device include an oven, a muffle furnace, an infrared lamp heating device, and a tubular furnace but the present invention is not necessarily limited to these baking devices.

Fixing Device

A fixing device 114 is a fixing device for use in an electrophotographic image forming apparatus, in which the fixing member according to the present invention is disposed as a fixing belt or a fixing roller.

Hereinafter, one embodiment of the fixing device 114 is described taking a fixing device of a fixing belt system having the above-described fixing belt 3 as an example.

Figure 2:
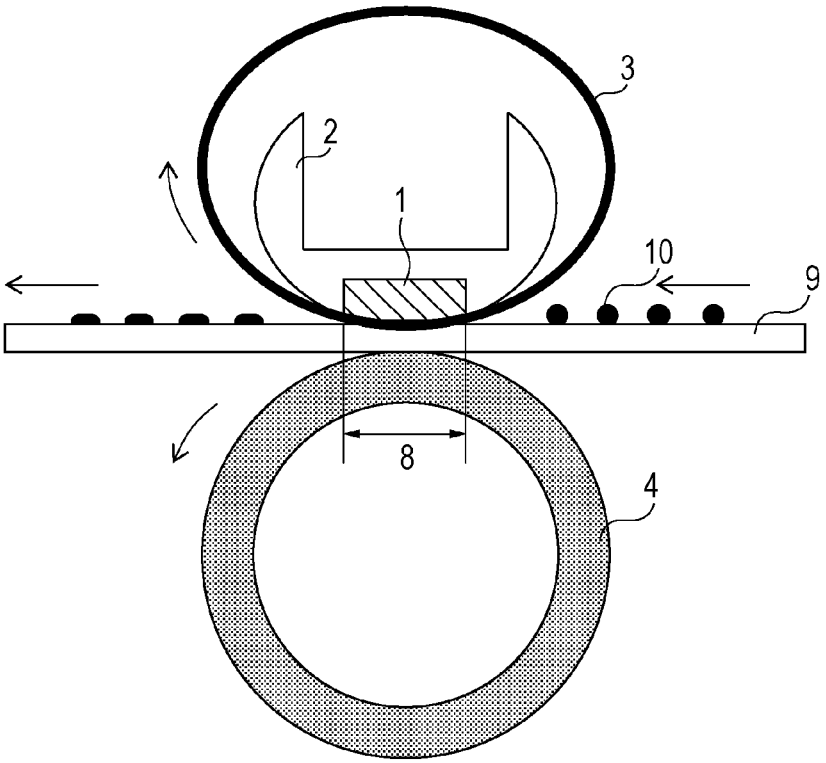
FIG. 2 is a schematic view of an example of the configuration of a fixing device according to the present invention.

FIG. 2 is a schematic view of the cross section of the fixing device 114.

The fixing device 114 has a ceramic heater 1 as a heating member, a heater holder 2 as a support member, an endless fixing belt 3 as a heating rotation member, and a pressing member 4 as a pressing rotation member (back-up member).

The heater holder 2 contains a heat-resistant material having rigidity and has a horizontal cross section of an approximately gutter shape. The ceramic heater (hereinafter referred to as a "heater") 1 is supported by a groove portion provided in the undersurface at the center of the heater holder 2.

The fixing belt 3 is loosely fitted onto the outer periphery of the heater holder 2 on which the heater 1 is supported. Furthermore, grease is applied to the inner peripheral surface (inner periphery) of the fixing belt 3 in order to increase slidability with the heater 1.

The pressing member 4 is disposed approximately in parallel to the fixing belt 3 below the fixing belt 3. A predetermined pressure is applied between the pressing member 4 and the heater 1 by a pressing mechanism (not illustrated) and the fixing belt 3 is pressed to the heater 1 side. The pressure causes elastic deformation of the elastic layer 6 of the fixing belt 3, so that a fixing nip portion 8 with a predetermined width is formed between the surface of the fixing belt 3 and the surface of the pressing member 4.

The pressing member 4 is rotated and driven in the counterclockwise direction indicated by the arrow at a predetermined rate by a motor (not illustrated) controlled by a control circuit portion (not illustrated) at least in image formation. By the rotation of the pressing member 4, frictional force arises between the pressing member 4 and the fixing belt 3 in the nip portion 8. Thus, the fixing belt 3 rotates in the clockwise direction indicated by the arrow at a peripheral speed almost corresponding to the rotation peripheral speed of the pressing member 4 while sliding in the state where the inner surface of the fixing belt 3 closely contacts the bottom surface of the ceramic heater 1. More specifically, the fixing belt 3 is rotated at the almost same peripheral speed as the conveyance speed of the recording material 9 bearing the non-fixed toners 10 to be conveyed from the image formation portion side.

In the state where the temperature of the ceramic heater 1 is adjusted to a predetermined fixing temperature and the pressing member 4 is rotated and driven, the recording material 9 having the non-fixed toners 10 is introduced into the nip portion 8 with the toner image bearing surface side facing the fixing belt 3 side. In the nip portion 8, the recording material 9 closely contacts the outer surface of the fixing belt 3, and then pinched and conveyed together with the fixing belt 3. Thus, the heat of the ceramic heater 1 is applied through the fixing belt 3 and pressure is applied through the pressing member 4 to the recording material 9, so that the non-fixed toners 10 are fixed to the surface of the recording material 9. The recording material 9 passing through the nip portion 8 is self-separated from the outer peripheral surface of the fixing belt 3 to be conveyed to the outside of the fixing device.

Image Forming Apparatus

Figure 3:
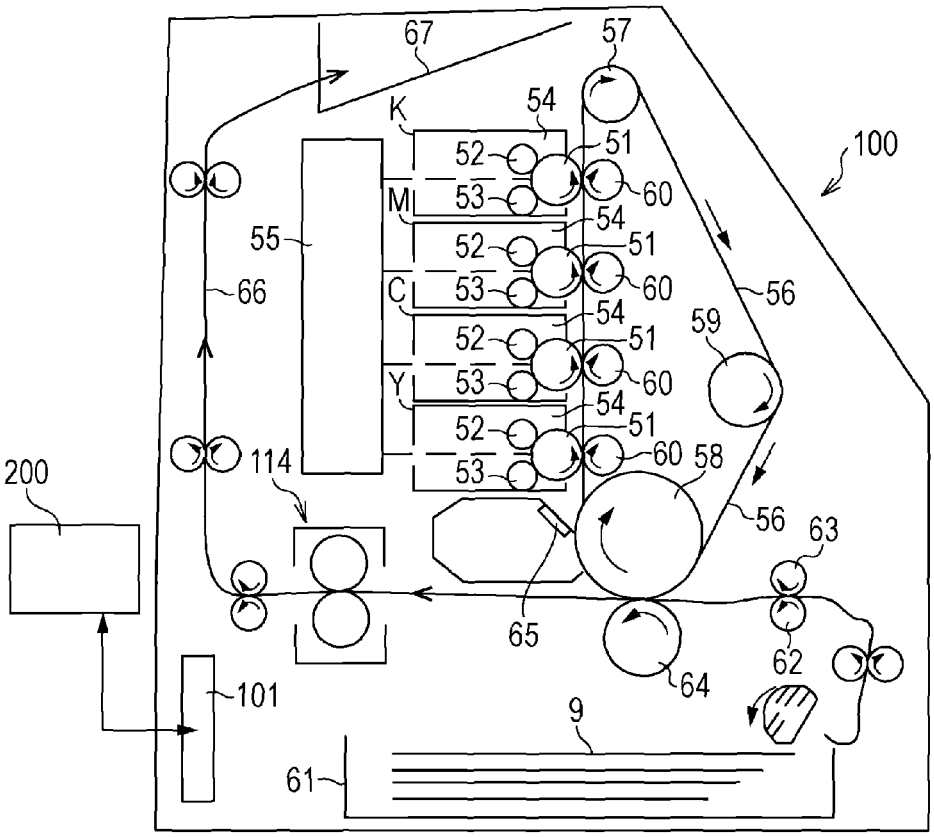
FIG. 3 is a schematic view of an example of the configuration of an image forming apparatus according to the present invention.

FIG. 3 is a schematic view of the configuration of an example of an image forming apparatus 100 having the fixing device 114, which employs the fixing belt as the fixing member according to the present invention, as a fixing device which heat-treats non-fixed toners on a recording material for fixing. This image forming apparatus 100 is a color printer employing an electrophotographic system.

The image forming apparatus 100 performs color image formation on the recording material 9 of a sheet shape as a recording material based on electrical image signals to be input into a control circuit portion (control unit) 101 on the image forming apparatus side from an external host device 200, such as a personal computer or an image reader. The control circuit portion 101 contains a CPU (calculation portion) and a ROM (storing unit) and delivers and receives various kinds of electrical information to/from a host device 200 or an operating portion (not illustrated) of the image forming apparatus 100. Moreover, the control circuit portion 101 comprehensively controls the image formation operation of the image forming apparatus 100 according to a predetermined control program or a reference table.

Y, C, M, and K are four image formation portions forming color toner images of yellow, cyan, magenta, and black, respectively, and are arranged in the order of Y, C, M, and K from the bottom in the image forming apparatus. Each of the image formation portions Y, C, M, and K has an electrophotographic photosensitive drum 51 as an image bearing member, and a charge device 52, a development device 53, and a cleaning device 54 as process units acting on the drum 51. A yellow toner is accommodated as a developing agent in the development device 53 of the yellow image formation portion Y. A cyan toner is accommodated as a developing agent in the development device 53 of the cyan image formation portion C. A magenta toner is accommodated as a developing agent in the development device 53 of the magenta image formation portion M. A black toner is accommodated as a developing agent in the development device 53 of the black image formation portion K. An optical system 55 forming an electrostatic latent image by exposing the drums 51 is provided corresponding to the image formation portions Y, C, M, and K of the four colors. As the optical system, a laser scanning exposure optical system is used.

In each of the image formation portions Y, C, M, and K, the drum 51 uniformly charged by the charge device 52 is subjected to scanning exposure based on image data by the optical system 55. Thus, an electrostatic latent image corresponding to an image pattern subjected to the scanning exposure is formed on each drum surface. The electrostatic latent images are developed as toner images by the development devices 53. More specifically, for example, a yellow toner image corresponding to a yellow component image of a full color image is formed on the drum 51 of the yellow image formation portion Y.

The color toner images formed on the image formation portions Y, C, M, and K are successively superimposed on an intermediate transfer body 56, which rotates at an approximately uniform speed, in a predetermined alignment state while being synchronized with the rotation of each drum 51, and then primarily transferred. Thus, a non-fixed full color toner image is synthesized and formed on the intermediate transfer body 56. In this Example, an endless intermediate transfer belt is used as the intermediate transfer body 56, and the belt 56 is wound and stretched around three rollers of a driving roller 57, a secondary transfer roller counter roller 58, and a tension roller 59 and is driven by the driving roller 57.

As a primary transfer unit for the toner image from the drum 51 of each of the image formation portions Y, C, M, and K onto the belt 56, a primary transfer roller 60 is used.

A primary transfer bias having a polarity opposite to the polarity of the toner is applied to each roller 60 from a bias power supply (not illustrated). Thus, a toner image is primarily transferred to the belt 56 from the drum 51 of each of the image formation portions Y, C, M, and K.

After the toner image is primarily transferred from the drum 51 to the belt 56 in each of the image formation portions Y, C, M, and K, toner remaining on each drum 51 is removed by each cleaning device 54.

The above-described process is performed for each of the yellow, cyan, magenta, and black colors synchronized with the rotation of the belt 56, so that a primarily transferred toner image of each color is successively formed on the belt 56 in an overlapping manner. In the formation of an image of only a single color (single color mode), the above-described process is performed only for the target color.

On the other hand, one of the recording materials 9 in a recording material cassette 61 is separated and fed by a feed roller 62 at a predetermined timing. Then, the recording material 9 is conveyed at a predetermined timing by a resist roller 63 to a transfer nip portion which is a pressure contact portion between an intermediate transfer belt portion wound around the secondary transfer roller counter roller 58 and the secondary transfer roller 64. The primarily transferred toner images formed on the belt 56 are transferred at once onto the recording material 9 by a bias having a polarity opposite to the polarity of the toner to be applied to the secondary transfer roller 64 from the bias power supply (not illustrated) (secondary transfer).

A secondary untransferred toner remaining on the belt 56 after the secondary transfer is removed by an intermediate transfer belt cleaning device 65. A non-fixed toner image secondarily transferred onto the recording material 9 is subjected to melting, mixing of colors, and fixing on the recording material 9 by the fixing device 114, and then sent as a full color print to an output tray 67 through an output path 66.

According to one aspect of the present invention, a fixing member excellent in durability and having a smooth surface with few surface defects can be obtained.

According to another aspect of the present invention, a fixing device and an image forming apparatus capable of stably providing a high-definition image.

EXAMPLES

Production of Fixing Member

Fixing Belt E1

A stainless steel (SUS) substrate having an outer diameter of 30 mm, a thickness of 40 μm, and a length of 240 mm was prepared. Onto the substrate, a liquid silicone rubber mixture (manufactured by Toray Industries Dow Corning: DY35-4097) was applied with a thickness of 300 μm through a primer (manufactured by Toray Industries Dow Corning: DY39-051) by a ring coating method, and then cross-linked to form an elastic layer. The crosslinking was performed at 200° C. for 4 hours by a warm air circulation type oven.

Next, the surface of the elastic layer was subjected to UV treatment.

Next, a liquid obtained by diluting 3-aminopropyl triethoxysilane (trade name:KBE-903, manufactured by Shin-Etsu Silicone) with ethanol to 5 times in terms of weight ratio was applied as a silane coupling agent to the surface of the elastic layer by spraying, and then naturally dried at room temperature. The process was performed in such a manner that the film thickness of a coating film of the silane coupling agent after drying was 1.0 μm.

Next, a coating solution for forming the release layer in which PFA resin particles having a MFR of 3 g/10 min (trade name: 350-J; manufactured by Du Pont-Mitsui Fluorochemicals Co., Ltd.,) and an acrylic resin having a decomposition temperature (T1) of 240° C. as a film forming agent were added and dispersed in water, was applied to the surface of the elastic layer by spraying. Thereafter, the coating solution was dried at room temperature for 15 minutes to form a coating film of the coating solution for forming a release layer. The melting point (T2) of the PFA resin used for the production of the fixing belt is 310° C.

Then, a belt on which the coating film was formed was put into a furnace adjusted to 360° C., and then held for 1 minute, so that the PFA resin was heated and melted. At this time, the temperature of the coating film was measured by a thermocouple inserted immediately under the coating film, and then the temperature increase rate of the coating film was calculated to be 5° C./second. Thereafter, the obtained belt was rapidly cooled with cold air to obtain a fixing belt E1 having a release layer whose thickness of 25 μm.

Fixing Belt E2

A fixing belt E2 was produced in the same manner as in Example 1, except changing the film thickness of a release layer to 20 μm and changing the temperature increase rate to 7° C./second.

Fixing Belt E3

A fixing belt E3 was produced in the same manner as in Example 1, except changing the film thickness of a release layer to 20 μm and changing the temperature increase rate to 3° C./second.

Fixing Belt E4

A fixing belt E4 was produced in the same manner as in Example 1, except changing the film thickness of a release layer to 20 μm, changing the temperature increase rate to 3° C./second, and using an acrylic resin having a decomposition temperature (T1) of 260° C. as a film forming agent.

Fixing Belt E5

A fixing belt E5 was produced in the same manner as in Example 1, except changing the film thickness of a release layer to 20 μm and using PFA resin particles having a MFR of 1 g/10 min (manufactured by Du Pont-Mitsui Fluorochemicals Co., Ltd.: 451HP-J) as fluororesin particles.

Fixing Belts E6 to E8

Fixing belts E6 to E8 were produced in the same manner as in Example 1, except changing the film thickness of a release layer to 20 μm.

Fixing Belt E9

A fixing belt E9 was produced in the same manner as in Example 1, except changing the film thickness of a release layer to 15 μm.

Fixing Belt C1

A fixing belt C1 was produced in the same manner as in Example 1, except changing the film thickness of a release layer to 20 μm and changing the temperature increase rate to 10° C./second.

Fixing Belt C2

A fixing belt C2 was produced in the same manner as in Example 1, except changing the film thickness of a release layer to 20 μm and changing the temperature increase rate to 2° C./second.

Fixing Belt C3

A fixing belt C3 was produced in the same manner as in Example 1, except changing the film thickness of a release layer to 20 μm and using PFA resin particles having a MFR of 8 g/10 min (manufactured by Du Pont-Mitsui Fluorochemicals Co., Ltd.: 945HP Plus) as fluororesin particles.

Fixing Belt C4

A fixing belt C4 was produced in the same manner as in Example 1, except changing the film thickness of a release layer to 10 μm.

Surface Observation of Fixing Belts

With respect to the fixing belts E1 to E9 and the fixing belts C1 to C4 produced above, the surface of the release layer was visually observed to investigate the presence or absence of the generation of surface defects resulting from cracks or voids. The results are shown in Table 1.

In the fixing belts E1 to E9 having a temperature increase rate in the range of 3° C./second or more and 7° C./second or less in the results of Table 1, voids or cracks were not observed. However, in the fixing belt C1 according to Comparative Example 1 in which the temperature increase rate is higher than 7° C./second, the generation of cracks was observed. In the fixing belt C2 according to Comparative Example 2 in which the temperature increase rate is less than 3° C./second, the generation of voids was observed.

Evaluation of Performance of Fixing Belts

The evaluation of performance described below was performed for the fixing belts E1 to E9 and the fixing belts C1 to C4 produced above. The evaluation results are collectively shown in Table 2.

(1) Durability Test

Each of the fixing belts above was subjected to a durability test in order to evaluate the durability of the release layer. First, each fixing belt was attached to a fixing device having the configuration shown in FIG. 2, and then the fixing device was incorporated in a laser beam printer capable of outputting 60 sheets per minute (Process speed 350 mm/sec). Then, 300,000 sheets of A4 size paper were continuously passed in a continuous sheet passing mode. The surface temperature of each fixing belt in fixing was set to 200° C., and the paper was passed in an environment of a temperature of 15° C. and a humidity of 20%. Then, the fixing belt was removed after the continuous sheet passing, and then the surface of the fixing belt was visually observed to evaluate the durability of the fixing belt according to the following criteria.

TABLE 1

| | Fixing member | Release layer thickness [μm] | Fluororesin MFR [g/min] | Fluororesin Melting point (T2) [° C.] | Acrylic resin Decomposition temperature (T1) [° C.] | Temperature rise time from T1 to T2 (t) [second] | Temperature increase rate (T2 − T1)/t [° C./second] | Surface observation of release layer Void | Surface observation of release layer Crack |
|---|---|---|---|---|---|---|---|---|---|
| Ex. 1 | Fixing belt E1 | 25 | 3 | 310 | 240 | 14 | 5 | None | None |
| Ex. 2 | Fixing belt E2 | 20 | 3 | 310 | 240 | 10 | 7 | None | None |
| Ex. 3 | Fixing belt E3 | 20 | 3 | 310 | 240 | 23 | 3 | None | None |
| Ex. 4 | Fixing belt E4 | 20 | 3 | 310 | 260 | 17 | 3 | None | None |
| Ex. 5 | Fixing belt E5 | 20 | 1 | 310 | 240 | 14 | 5 | None | None |
| Ex. 6 | Fixing belt E6 | 20 | 3 | 310 | 240 | 14 | 5 | None | None |
| Ex. 7 | Fixing belt E7 | 20 | 3 | 310 | 240 | 14 | 5 | None | None |
| Ex. 8 | Fixing belt E8 | 20 | 3 | 310 | 240 | 14 | 5 | None | None |
| Ex. 9 | Fixing belt E9 | 15 | 3 | 310 | 240 | 14 | 5 | None | None |
| Comp. Ex. 1 | Fixing belt C1 | 20 | 3 | 310 | 240 | 7 | 10 | Generated | None |
| Comp. Ex. 2 | Fixing belt C2 | 20 | 3 | 310 | 240 | 35 | 2 | None | Generated |
| Comp. Ex. 3 | Fixing belt C3 | 20 | 8 | 290 | 240 | 10 | 5 | None | None |
| Comp. Ex. 4 | Fixing belt C4 | 10 | 3 | 310 | 240 | 14 | 5 | None | None |

Evaluation rank "A": Peeling of the release layer is not observed.

Evaluation rank "B": Peeling is observed in a portion (Paper edge portion) of the release layer on which the paper edge abuts.

(2) Fixing Test (2-1) Observation of Presence or Absence of Defects Resulting from Offset to Electrophotographic Image A test for evaluating the fixability of each fixing belt above was performed. Each fixing belt above was attached to a fixing device having the configuration shown in FIG. 2 in the same manner as in (1) above, and then the fixing device was incorporated in a laser beam printer capable of high-speed fixing of 60 sheets/minute (Process speed 350 mm/sec). Then, 250 sheets having an image formed by forming 5 mm square black and halftone (gray) patterns each at 9 places on one sheet were continuously output using a rough paper (manufactured by Fox River Paper Co.: Fox River Bond) of a letter size having a basis weight of 75 g/cm$^2$ as the recording material 9. The surface temperature of the fixing belt during image outputting was set to 200° C. The images were output in an environment of a temperature of 15° C. and a relative humidity of 20%. Then, it was confirmed whether or not image defects due to offset were observed in the image of the 250th sheet.

(2-2) Measurement and Evaluation of Density-Decreasing Rate

The image of the 250th sheet subjected to the evaluation according to (2-1) above was subjected to a rubbing test in a laboratory maintained in an environment of a temperature of 15° C. and a relative humidity of 20%. The rubbing test was performed by pressing a 22 mm square lens-cleaning paper against the image with a 190 g force, and then rubbing the image with the paper by 10 times in the state. Then, the optical density of all the patterns before and after the rubbing was measured using a densitometer (manufactured by Macbeth), and then the density-decreasing rate was calculated by the following expression.

Expression $$\text{Density-decreasing rate}=\text{Optical density after rubbing}/\text{Optical density before rubbing}\times 100$$

A lower density-decreasing rate in the rubbing test indicates that the fixability is better. The density-decreasing rate was calculated on all the patterns on the image of the 250th sheet, and then the fixability of the fixing belt was evaluated according to the following criteria.

Evaluation rank "A": In all the patterns, the density-decreasing rate is 20% or less.

Evaluation rank "B": There are one or more patterns in which the density-decreasing rate exceeds 20%.

(3) Measurement of Surface Property Parameters

By the methods described above, the arithmetic average roughness (Sa) and the maximum cross sectional height (St) were individually calculated in the entire surface region of the release layer of each fixing belt. Then, the minimum value and the maximum value among the obtained arithmetic average roughness (Sa) values were determined, and then were defined as Sa (min) and Sa (max), respectively. The maximum value of the obtained maximum cross sectional height (St) values was determined as St (max).

TABLE 2

| | | Evaluation results | | | | | |
|---|---|---|---|---|---|---|---|
| | | | | | Surface property parameters | | |
| | | | (2) Fixing test | | Sa | Sa | St |
| | Fixing member | (1) Durability | (2-1) Presence or absence of offset | (2-2) Evaluation rank of density-decreasing rate | (min) [μm] | (max) [μm] | (max) [μm] |
| Ex. 1 | Fixing belt E1 | A | None | A | 0.1 | 0.3 | 3.3 |
| Ex. 2 | Fixing belt E2 | A | None | A | 0.2 | 0.4 | 5.4 |
| Ex. 3 | Fixing belt E3 | A | None | A | 0.2 | 0.4 | 4.7 |
| Ex. 4 | Fixing belt E4 | A | None | A | 0.2 | 0.5 | 7.0 |
| Ex. 5 | Fixing belt E5 | A | None | A | 0.1 | 0.5 | 4.8 |
| Ex. 6 | Fixing belt E6 | A | None | A | 0.2 | 0.4 | 3.4 |
| Ex. 7 | Fixing belt E7 | A | None | A | 0.1 | 0.2 | 2.4 |
| Ex. 8 | Fixing belt E8 | A | None | A | 0.2 | 0.5 | 6.9 |
| Ex. 9 | Fixing belt E9 | A | None | A | 0.2 | 0.3 | 2.6 |
| Comp. Ex. 1 | Fixing belt C1 | A | None | B | 0.9 | 1.8 | 22.7 |
| Comp. Ex. 2 | Fixing belt C2 | A | None | B | 0.2 | 1.2 | 31.9 |
| Comp. Ex. 3 | Fixing belt C3 | B Peeling occurred at 150000th sheet. | None | A | 0.1 | 0.3 | 2.4 |
| Comp. Ex. 4 | Fixing belt C4 | B Peeling occurred at 200000th sheet. | None | A | 0.2 | 0.3 | 2.6 |

In the fixing belts according to Examples, a desired arithmetic average roughness (Sa) was able to be achieved without grinding the surface of the belts after baking the fluororesin. Moreover, all the fixing belts according to Examples were excellent in durability, fixability, and offset properties.

On the other hand, the fixability decreased in the fixing belt having a large arithmetic average roughness (Sa) value according to Comparative Example 1.

In the fixing belt produced using a PFA resin having an excessively large MFR according to Comparative Example 3, the durability was not good even when the numerical values of the surface quality parameters fell in the ranges mentioned above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-119286, filed Jun. 12, 2015, which is hereby incorporated by reference herein in its entirety.

What is claimed is:

1. A method for manufacturing a fixing member, the fixing member having:

a substrate, an elastic layer on the substrate, and a release layer on the elastic layer, the release layer having a thickness of 15 μm or more and 25 μm or less, and containing a fluororesin, the method comprising the steps of:

(1) providing a coating solution containing:

the fluororesin, wherein the fluororesin has a melt flow rate (MFR) of 1 g/10 min or more and 3 g/10 min or less, and an acrylic resin;

(2) forming a coating film of the coating solution on the elastic layer; and (3) baking the coating film to melt the fluororesin therein, covering a surface of the elastic layer with the melted fluororesin, and forming the release layer, wherein the step (3) includes: heating the coating film from T1° C. to T2° C. at a temperature increase rate of 3° C./second or more and 7° C./second or less, and then heating the coating film at T2° C. or higher than T2° C., where, T1° C. is a decomposition temperature of the acrylic resin, and T2° C. is the melting point of the fluororesin.

2. The method for manufacturing the fixing member according to claim 1, wherein the elastic layer contains silicone rubber.

3. The method for manufacturing the fixing member according to claim 1, wherein the fluororesin is a PFA resin.

4. The method for manufacturing the fixing member according to claim 1, wherein the melting point (T2° C.) of the fluororesin is 280° C. or more and 320° C. or less.

5. The method for manufacturing the fixing member according to claim 1, wherein the decomposition temperature (T1° C.) of the acrylic resin is 200° C. or more and 280° C. or less.

6. The method for manufacturing the fixing member according to claim 1, wherein the fluororesin contained in the coating solution has a particle shape of which a volume average particle diameter is 0.1 μm or more and 0.5 μm or less.

7. The method for manufacturing the fixing member according to claim 1, wherein the coating solution further comprises an additional fluororesin whose MFR is outside the range of 1 g/10 min or more and 3 g/10 min or less, and an entire MFR of all the fluororesins in the coating solution for forming a release layer is 1 g/10 min or more and 3 g/10 min or less.

8. A fixing member comprising:

a substrate;

an elastic layer on the substrate; and a release layer on the elastic layer, wherein the release layer:

has a thickness of 15 μm or more and 25 μm or less, and contains a fluororesin, contains a fluororesin having a melt flow rate (MFR) of 1 g/10 min or more and 3 g/10 min or less, results from baking a coating film of a coating solution for forming a release layer, provided on the elastic layer, the coating solution containing the fluororesin, and has a surface having arithmetic average roughness (Sa) of 0.1 μm or more and 0.5 μm or less, and having maximum cross sectional height (St) of 10.0 μm or less.

9. The fixing member according to claim 8, wherein the elastic layer contains silicone rubber.

10. The fixing member according to claim 8, wherein the fluororesin is a PFA resin.

11. The fixing member according to claim 8, an entire MFR of fluororesins contained in the release layer is 1 g/10 min or more and 3 g/10 min or less.

12. An image forming apparatus having a fixing device having a fixing member and a heating unit, wherein the fixing member has:

a substrate, an elastic layer on the substrate, and a release layer on the elastic layer, wherein the release layer:

has a thickness of 15 μm or more and 25 μm or less, contains a fluororesin having a melt flow rate (MFR) of 1 g/10 min or more and 3 g/10 min or less, results from baking a coating film of a coating solution for forming a release layer, on the elastic layer, the coating solution containing the fluororesin, and has a surface having arithmetic average roughness (Sa) of 0.1 μm or more and 0.5 μm or less, and having maximum cross sectional height (St) of 10.0 μm or less.

* * * * *